US006076377A

United States Patent [19]

Ta-An

[11] Patent Number: 6,076,377

[45] Date of Patent: Jun. 20, 2000

[54] WARP KNIT FABRIC FOR A CLEAR ZIPPER

[76] Inventor: Hung Ta-An, No. 201 Chen-Hsird. Her-Mei Town, Chang-Hua Shien, Taiwan

[21] Appl. No.: 09/071,463

[22] Filed: May 4, 1998

[51] Int. Cl.[7] ..... D04B 21/00

[52] U.S. Cl. ..... 66/195; 66/193

[58] Field of Search ..... 66/169 R, 170, 66/172 R, 195, 169 A, 202; 24/392, 393

[56] References Cited

U.S. PATENT DOCUMENTS

| | | | |
|---|---|---|---|
| 4,015,450 | 4/1977 | Matsuda et al. | 66/195 |
| 4,047,265 | 9/1977 | Matsuda | 66/195 |
| 4,067,208 | 1/1978 | Heimberger | 66/195 |
| 5,502,986 | 4/1996 | Matsuda et al. | 66/195 |
| 5,685,177 | 11/1997 | Matsuda et al. | 66/195 |

*Primary Examiner*—Danny Worrell
*Attorney, Agent, or Firm*—Bacon & Thomas, PLLC

[57] ABSTRACT

A warp knit fabric for a clear zipper has imaginary longitudinal axes arranged in parallel. First knitting yarns are respectively lapped around the imaginary longitudinal axes to form respective longitudinal series of crochets. Second knitting yarns are respectively lapped around every two adjacent imaginary longitudinal axes and advanced alternatively and knitted between a left side and a right side. Third knitting yarns are respectively lapped around every three adjacent imaginary longitudinal axes and advanced alternatively and knitted between a left side and a right side. At least one reinforcing knitting yarn is respectively lapped around at least two adjacent imaginary longitudinal axes and advanced alternatively and knitted between a left side and a right side and overlapped on top and bottom sides of the second knitting yarns or the third knitting yarns, forming at least one longitudinally extended reinforcing zone.

3 Claims, 4 Drawing Sheets

WARP KNIT FABRIC FOR A CLEAR ZIPPER

BACKGROUND OF THE INVENTION

1. Field of the Invention

The present invention relates to warp knitting fabrics for zippers, and more particularly to such a warp knit fabric which has reinforced zones for supporting the synthetic coil (teeth) against transverse stretching forces.

2. Description of Related Art

Referring to FIG. 4, a regular clear zipper 10 is generally comprised of two fabric tapes 12, two interlocking coils 14 respectively fastened to the fabric tapes 12, and a slide 16 to close/open the interlocking coils 14. When the coils 14 are fastened to the respective fabric tapes 12 by stitches, the fabric tapes 12 are folded up and sealed by a hot press, and then the slide is coupled between the coils 14. When pulling the slide 16 to close the interlocking coils 14, folded edges 13 of the fabric tapes 12 are abutted against each other, enabling the interlocked coils 14 to be received on the inside and kept out of view. Because clear zippers are commonly used with summer clothes and the fabric tapes 12 of the invisible zippers each have a folded edge 13, the fabric tapes 12 must be made light and highly flexible. Therefore, fabric tapes for invisible zippers are generally made by warp knitting. As illustrated in FIG. 5, the fabric tape 12 is comprised of a plurality of first knitting yarn 121, a plurality of second knitting yarns 122, and a plurality of third knitting yarns 123. The first knitting yarns 121 advanced knitted into laps. The second knitting yarns 122 are knitted into a tricot. The third knitting yarns 123 are alternatively and knitted between its left side and right side. Further, the coils 14 are respectively made from a synthetic wire directly fastened to mounting areas 124 at the respective fabric tapes 12. The mounting areas 124 are spaced from the two side edges of the respective fabric tape 12 at about two stitches. Because the mounting areas 124 are close to the side edges of the respective fabric tape 12, they tear easily when the zipper 10 is stretched transversely. When the zipper 10 has a tear in the mounting areas 124, the fabric tapes 12 become unable to support the coils 14 in position, and the coils 14 may be deformed, thereby preventing the coils 14 from becoming locked/unlocked. In order to reinforcing the structural strength of the fabric tapes 12, fill knitting yarns may be knitted with warp knitting yarns. However, such a knitting method greatly increases the thickness of the fabric tapes. Fabric tapes made according to such a knitting method are suitable for use with winter clothes.

SUMMARY OF THE INVENTION

The present invention has been accomplished to provide a warp knit fabric for a clear zipper which eliminates the aforesaid problems. It is one object of the present invention to provide a warp knit fabric which provides high structural strength against transverse stretching. It is another object of the present invention to provide a warp knit fabric which is practical for use in making clear zippers for summer clothes as well as winter clothes. To achieve these and other objects of the present invention, there is provided a warp knit fabric which comprises a plurality of imaginary longitudinal axes arranged in parallel, a plurality of first knitting yarns respectively lapped around the imaginary longitudinal axes and forming respective longitudinal series of crochets, a plurality of second knitting yarns respectively lapped around every two adjacent imaginary longitudinal axes and alternatively knitted forwards between the left side and the right side, and a plurality of third knitting yarns respectively lapped around every three adjacent imaginary longitudinal axes and alternatively knitted forwards between the left side and the right side, and at least one reinforcing knitting yarn respectively lapped around at least two adjacent imaginary longitudinal axes and alternatively knitted forwards between the left side and the right side and overlapped on top and bottom sides of the second knitting yarns or the third knitting yarns, forming at least one longitudinally extended reinforcing zone.

DETAILED DESCRIPTION OF THE PREFERRED EMBODIMENT

Figure 4:
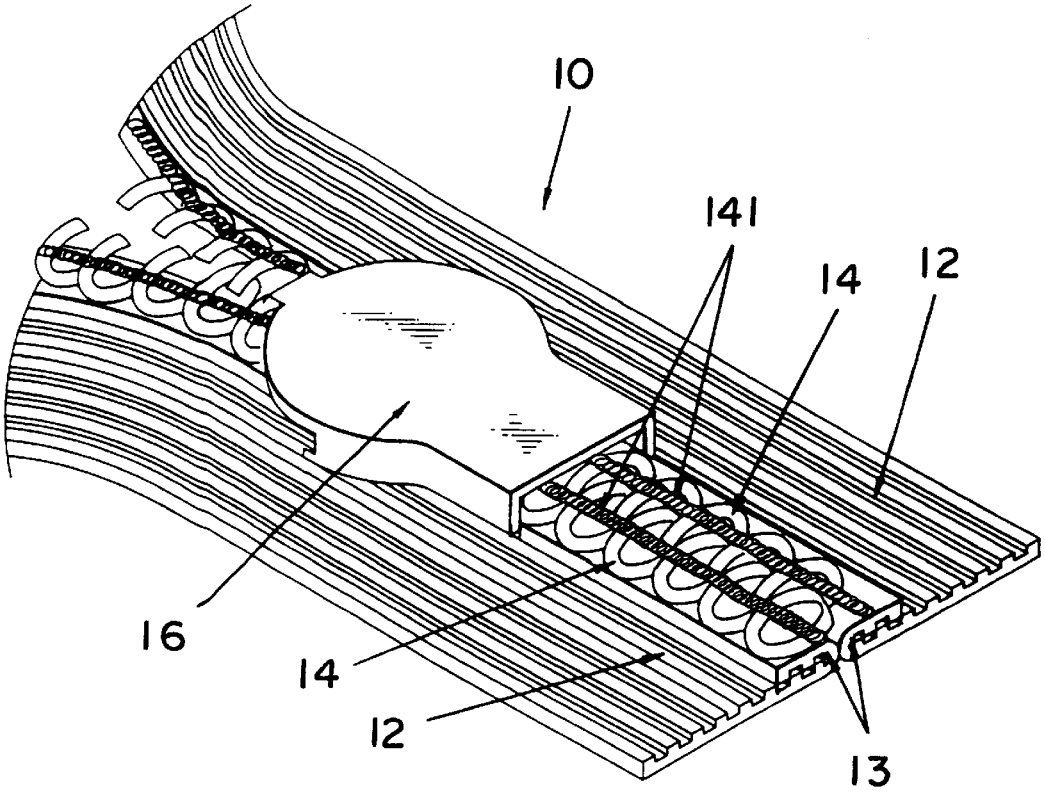
PRIOR ART FIG. 4
FIG. 4 illustrates a clear zipper constructed according to the prior art.
Figure 1:
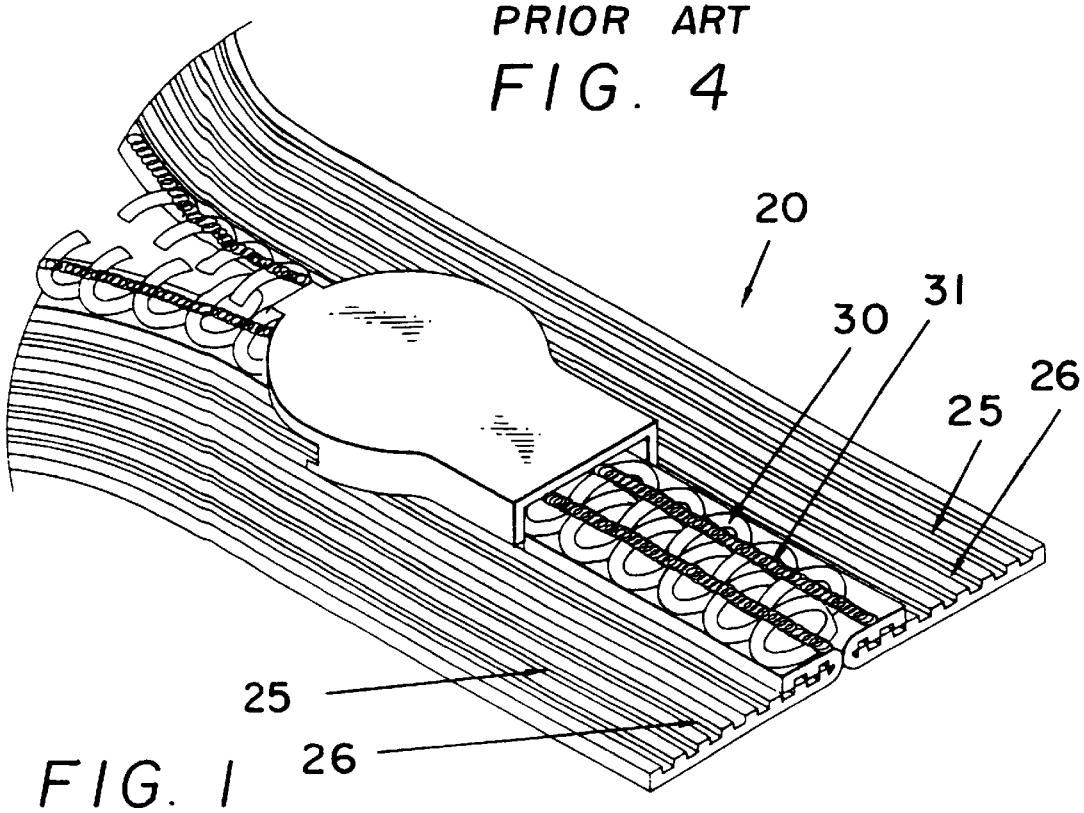
FIG. 1 illustrates a clear zipper constructed according to the present invention.
Figure 2:
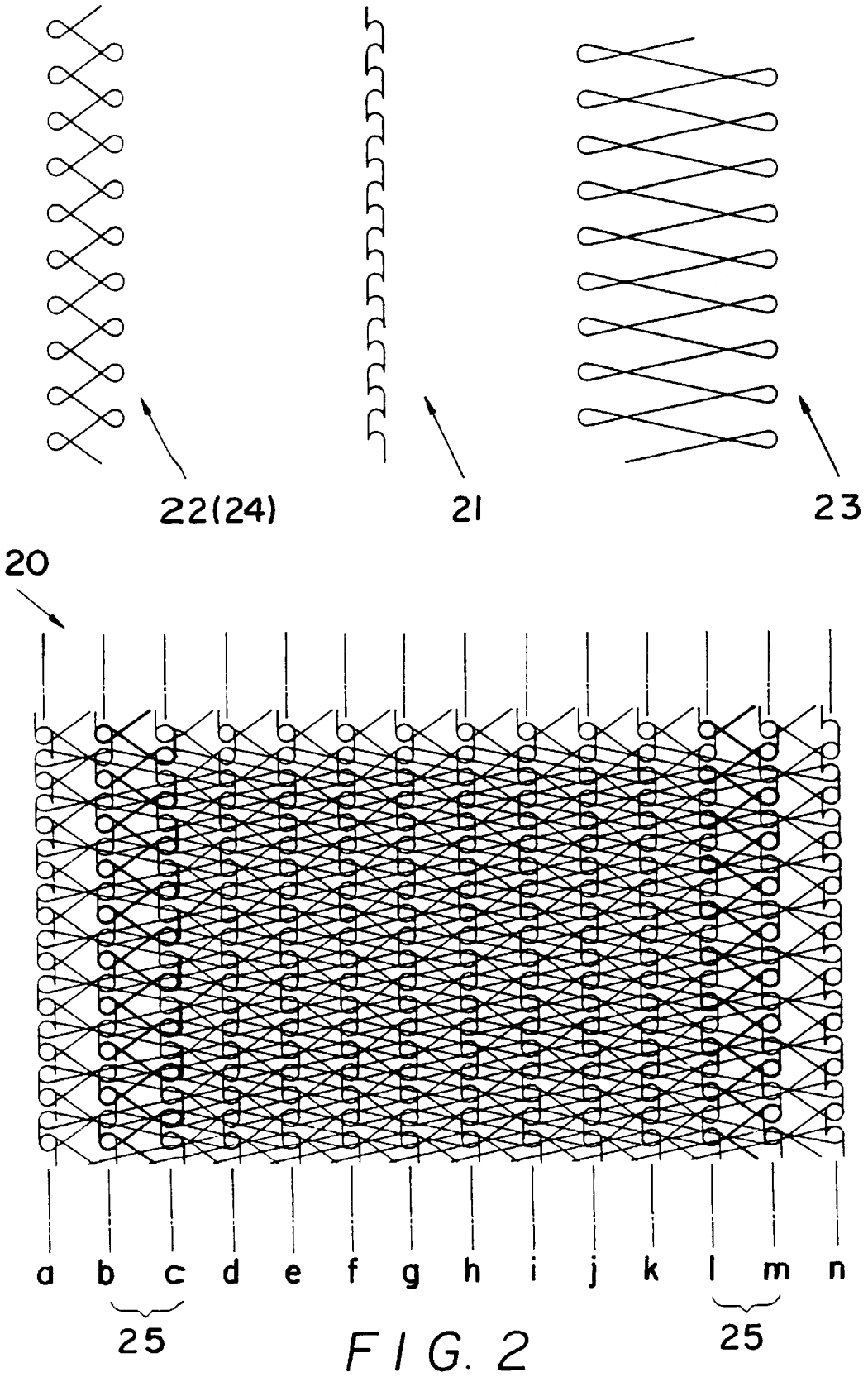
FIG. 2 is a plain view showing the fabric composition of the warp knit fabric for a clear zipper according to the present invention.

Referring to FIGS. 1 and 2 a warp knit fabric 20 in accordance with the present invention comprises 14 wales arranged in parallel and extended in longitudinal direction. The wales are ridges on the surface of the fabric. The wales have a respective imaginary longitudinal axis respectively referenced by a, b, c, . . . l, m, n.

The warp knitting fabric 20 is composed of 14 first knit yarns 21, 13 second knitting yarns 22. 11 third knitting yarns 23, and two reinforcing knitting yarns 24.

The first knitting yarns 21 are respectively lapped around the wales and knitted in direction from the top toward the bottom, forming a respective longitudinal series of crochets, that are linked with the second knitting yarns 22 and the third knitting yarns 23 respectively.

The second knitting yarns 22 are respectively lapped around the axes ab, bc, cd, . . . mn of every two adjacent wales and knitted in direction from the top toward the bottom and advanced alternatively and knitted between its left side and right side, forming a tricot. Every turning stroke of each second knitting yarn 22 is spaced by one stitch (i.e., spaced between two wales), therefore it is indicated by 1-1T.

The third knitting yarns 23 are respectively lapped around the axes ad, bc, cf, . . . kn of every four adjacent wales and knitted in direction from the top toward the bottom advanced alternatively and knitted between its left side and right side, then knitted to form a crochet at every fourth stitch and then returned to the first stitch after the formation of one crochet, therefore it is indicated by 1-3T (the so-called Satin).

The reinforcing knitting yarns 24 are of 1-1T type, and lapped around the axes b;c and the axes l;m respectively, forming two longitudinally extended, parallel first reinforcing zones 25, that are respectively spaced from the two opposite side edges of the warp knitting fabric 20 at a space about one stitch (see FIG. 2) and lapped on top and bottom sides of the first and third knitting yarns 21;23. Therefore, when the warp knit fabric 20 is used for making a clear zipper, it is folded up and sealed to hold a respective synthetic coil (teeth) 30 at an inner side, enabling the synthetic coil 30 to be secured to the first reinforcing zones 25 by stitches 31. Because the first reinforcing zones 25 are reinforced by the reinforcing knit yarns 24, the warp knit fabric 20 does not break when bearing a high transverse pulling force.

Figure 3:
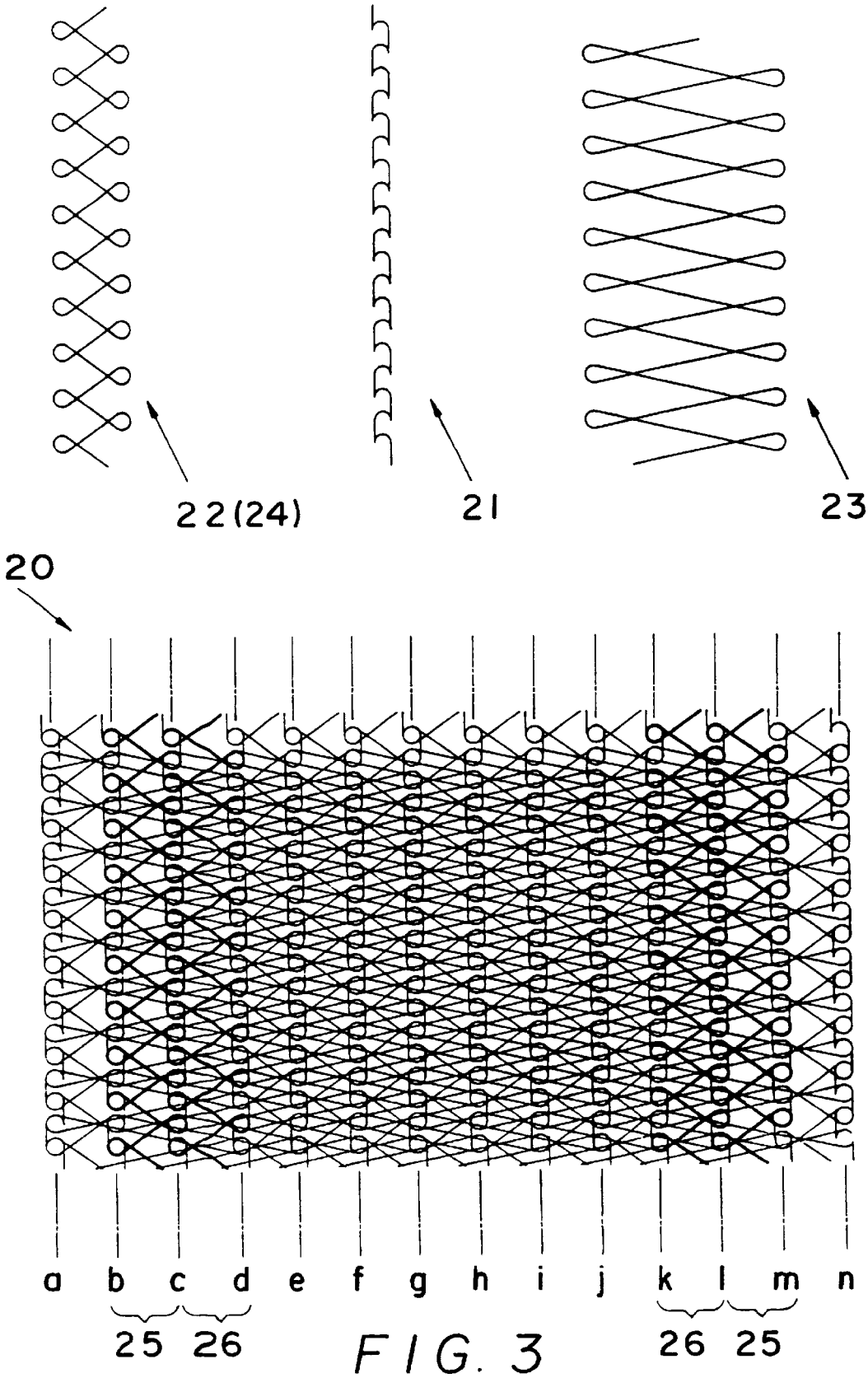
FIG. 3 is a plain view showing the fabric composition of an alternate form of the warp knit fabric according to the present invention.
Figure 5:
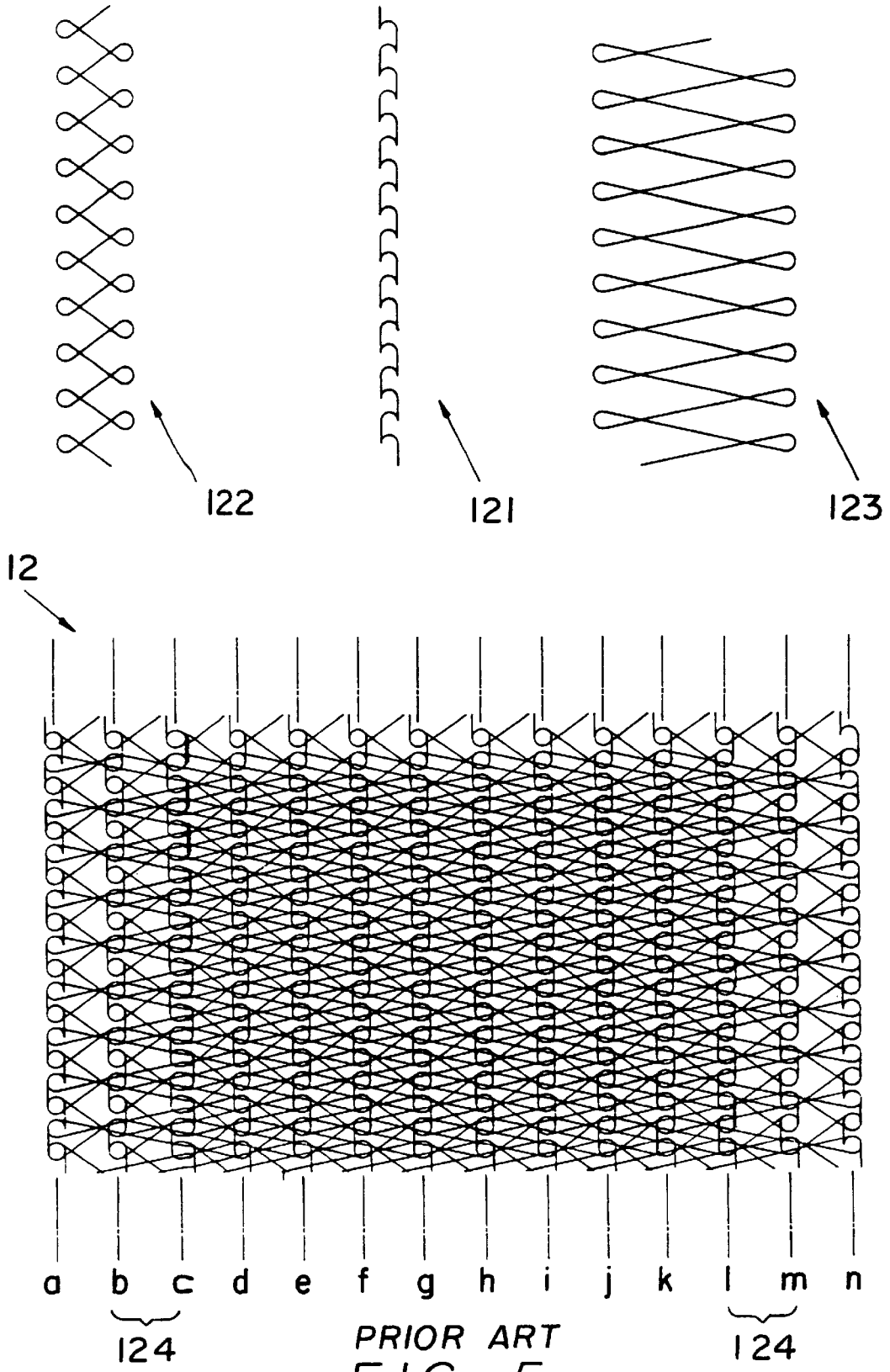
PRIOR ART FIG. 5
FIG. 5 is a plain view showing the fabric composition of a warp knit fabric for the clear zipper shown in FIG. 4.

Referring to FIG. 3 and FIG. 1 again, two additional 1-1T type reinforcing knitting yarns 24 may be added to the warp knit fabric 20 and lapped around the axes c;d and the axes k;l, forming two second reinforcing zones 26, that are disposed in parallel to and within the first reinforcing zones 25 and respectively spaced from the two opposite side edges of the warp knit fabric 20 at a space about two stitches. Therefore, when the synthetic coil 30 is fastened to the first reinforcing zones 25 of the warp knit fabric 20 by stitches 31 and the stitches 31 are deviated from course and stitched out of the first reinforcing zones 25, the warp knit fabric 20 is still strong enough to bear a high transverse pulling force.

By means of the design of the first reinforcing zones 25 and the second reinforcing zones 26, the synthetic coil 30 is well supported. Therefore, when the cloth is pulled by force and the warp knit fabrics 20 of the clear zipper are torn, the slide of the clear zipper can still be moved over the broken area of the warp knit fabrics 20 to unlock the interlocked synthetic coils 30, enabling the clothe to be taken off.

Furthermore, because 1-1T type knitting yarns are used for the reinforcing knitting yarns 24, the knitting of the reinforcing knitting yarns 24 does not significantly change the thickness of the warp knit fabric 20. Further, the reinforcing knitting yarns can also be selected from 1-3T type knitting yarns and lapped around the axes a;b;c;d and the axes k;l;m;n, forming two wide reinforcing zones which cover the areas of the aforesaid first reinforcing zones 25 and second reinforcing zones.

It is to be understood that the drawings are designed for purposes of illustration only, and are not intended as a definition of the limits and scope of the invention disclosed.

What is claimed is:

1. A warp knit fabric comprising:

a plurality of wales having imaginary longitudinal axes arranged in parallel to one another;

a plurality of first knitting yarns respectively lapped around said imaginary longitudinal axes and forming respective longitudinal series of crochets;

a plurality of second knitting yarns respectively lapped around every two adjacent imaginary longitudinal axes of said wales and advanced alternatively and knitted between the two adjacent imaginary longitudinal axes;

a plurality of third knitting yarns respectively lapped around every three adjacent imaginary longitudinal axes of said wales and advanced alternatively and knitted between the three adjacent imaginary longitudinal axes to form a second series of crochets; and at least one reinforcing knitting yarn lapped around at least two reinforcing adjacent imaginary longitudinal axes of said wales and advanced alternatively and knitted between the two reinforcing adjacent imaginary longitudinal axes and overlapped on top and bottom sides of at least one of said second knitting yarns and said third knitting yarns, forming at least one longitudinally extended reinforcing zone.

2. The warp knit fabric of claim 1, wherein said reinforcing zone bridges over at least three imaginary longitudinal axes of said wales.

3. The warp knit fabric of claim 1, wherein at least two said reinforcing knitting yarns are each lapped around two adjacent imaginary longitudinal axes of said wales, forming at least two parallel reinforcing zones that are respectively spaced from two opposite side edges of the warp knit fabric at a fixed distance.

* * * * *